US010636346B2

(12) United States Patent
Fang et al.

(10) Patent No.: US 10,636,346 B2
(45) Date of Patent: Apr. 28, 2020

(54) ELECTRONIC DEVICE FOR DRIVING DISPLAY PANEL AND OPERATION METHOD THEREOF

(71) Applicant: Novatek Microelectronics Corp., Hsinchu (TW)

(72) Inventors: Po-Hsiang Fang, Hsinchu (TW); Jhih-Siou Cheng, New Taipei (TW)

(73) Assignee: Novatek Microelectronics Corp., Hsinchu (TW)

( * ) Notice: Subject to any disclaimer, the term of this patent is extended or adjusted under 35 U.S.C. 154(b) by 47 days.

(21) Appl. No.: 15/976,830

(22) Filed: May 10, 2018

(65) Prior Publication Data

US 2019/0130813 A1 May 2, 2019

Related U.S. Application Data

(60) Provisional application No. 62/580,991, filed on Nov. 2, 2017.

(51) Int. Cl.
*G09G 3/20* (2006.01)

(52) U.S. Cl.
CPC ... *G09G 3/2092* (2013.01); *G09G 2300/0413* (2013.01); *G09G 2310/0264* (2013.01); *G09G 2310/0291* (2013.01); *G09G 2310/0294* (2013.01); *G09G 2310/0297* (2013.01); *G09G 2320/029* (2013.01); *G09G 2330/02* (2013.01)

(58) Field of Classification Search
CPC ..... G09G 3/2092; G09G 2300/0413; G09G 2300/02; G09G 2310/0291; G09G 2310/0294; G09G 2310/0297; G09G 3/20
See application file for complete search history.

(56) References Cited

U.S. PATENT DOCUMENTS

| | | | | |
|---|---|---|---|---|
| 2016/0225302 | A1* | 8/2016 | Shin | G09G 3/2003 |
| 2017/0108970 | A1* | 4/2017 | Kim | G06F 3/0412 |
| 2017/0169753 | A1* | 6/2017 | Hao | G09G 3/2018 |
| 2018/0122305 | A1* | 5/2018 | An | G09G 3/3275 |
| 2018/0190192 | A1* | 7/2018 | Kwon | G09G 3/3233 |
| 2018/0190207 | A1* | 7/2018 | Hwang | G09G 3/3291 |

* cited by examiner

*Primary Examiner* — Vinh T Lam
(74) *Attorney, Agent, or Firm* — JCIPRNET

(57) ABSTRACT

An electronic device for driving a display panel and an operation method thereof are provided. The electronic device includes a sensing circuit, a dummy sensing circuit, a multiplexer circuit and a processing circuit. The sensing circuit senses a sensing line of the display panel to output a sensing result. The dummy sensing circuit senses a dummy signal to output a dummy sensing result, wherein the dummy signal is related to a part of or all of signals of the sensing line. The multiplexer circuit time-divisionally outputs the dummy sensing result and the sensing result. The processing circuit is coupled to an output terminal of the multiplexer circuit to time-divisionally receive the dummy sensing result and the sensing result.

38 Claims, 7 Drawing Sheets

ELECTRONIC DEVICE FOR DRIVING DISPLAY PANEL AND OPERATION METHOD THEREOF

CROSS-REFERENCE TO RELATED APPLICATION

This application claims the priority benefit of U.S. provisional application Ser. No. 62/580,991, filed on Nov. 2, 2017. The entirety of the above-mentioned patent application is hereby incorporated by reference herein and made a part of this specification.

BACKGROUND

Field of the Invention

The invention relates to an electronic device. More particularly, the invention relates to an electronic device for driving a display panel and an operating method thereof.

Description of Related Art

Based on matching factors and/or based on process factors, dummy circuits are generally added next to function circuits in a circuit layout. The dummy circuits and the function circuits have the same circuit structure. In order to prevent uncertainty of voltages of the dummy circuits, input terminals of the dummy circuits are provided with a fixed voltage (e.g., a ground voltage). Based on the conventional technique, a considerable voltage difference may exist between output voltages of the dummy circuits and output voltages of the function circuits.

SUMMARY

The invention provides an electronic device for driving a display panel and an operating method thereof capable of diminishing a difference between sensing results of sensing circuits and dummy sensing results of dummy sensing circuits.

According to an embodiment of the invention, an electronic device capable of driving a display panel is provided. The electronic device includes at least one sensing circuit, at least one dummy sensing circuit, a multiplexer circuit and a processing circuit. The at least one sensing circuit is configured to be coupled to at least one sensing line of the display panel, wherein the at least one sensing circuit senses the at least one sensing line to output at least one sensing result. The at least one dummy sensing circuit is configured to sense at least one dummy signal to output at least one dummy sensing result, wherein the at least one dummy signal is related to a part of or all of signals of the at least one sensing line. The multiplexer circuit is coupled to the at least one dummy sensing circuit to receive the at least one dummy sensing result and coupled to the at least one sensing circuit to receive the at least one sensing result. The multiplexer circuit time-divisionally outputs the at least one dummy sensing result and the at least one sensing result from an output terminal of the multiplexer circuit. The processing circuit is coupled to the output terminal of the multiplexer circuit to time-divisionally receive the at least one dummy sensing result and the at least one sensing result.

According to an embodiment of the invention, an operation method of an electronic device for driving a display panel is provided. The operation method includes: sensing at least one sensing line of the display panel to output at least one sensing result by at least one sensing circuit; sensing at least one dummy signal to output at least one dummy sensing result by at least one dummy sensing circuit, wherein the at least one dummy signal is related to a part of or all of signals of the at least one sensing line; time-divisionally outputting the at least one dummy sensing result and the at least one sensing result from an output terminal of a multiplexer circuit by the multiplexer circuit; and time-divisionally receiving the at least one dummy sensing result and the at least one sensing result from the output terminal of the multiplexer circuit by a processing circuit.

To sum up, the at least one sensing circuit of the embodiments of the invention senses the at least one sensing line of the display panel, and the at least one dummy sensing circuit senses the at least one dummy signal, wherein the at least one dummy signal is related to the part of or the all of signals of the sensing lines of the display panel. Because the at least one dummy signal is related to the signals of the sensing lines, the difference between the at least one sensing result of the at least one sensing circuit and the at least one dummy sensing result of the at least one dummy sensing circuit can be effectively diminished.

To make the above features and advantages of the invention more comprehensible, embodiments accompanied with drawings are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
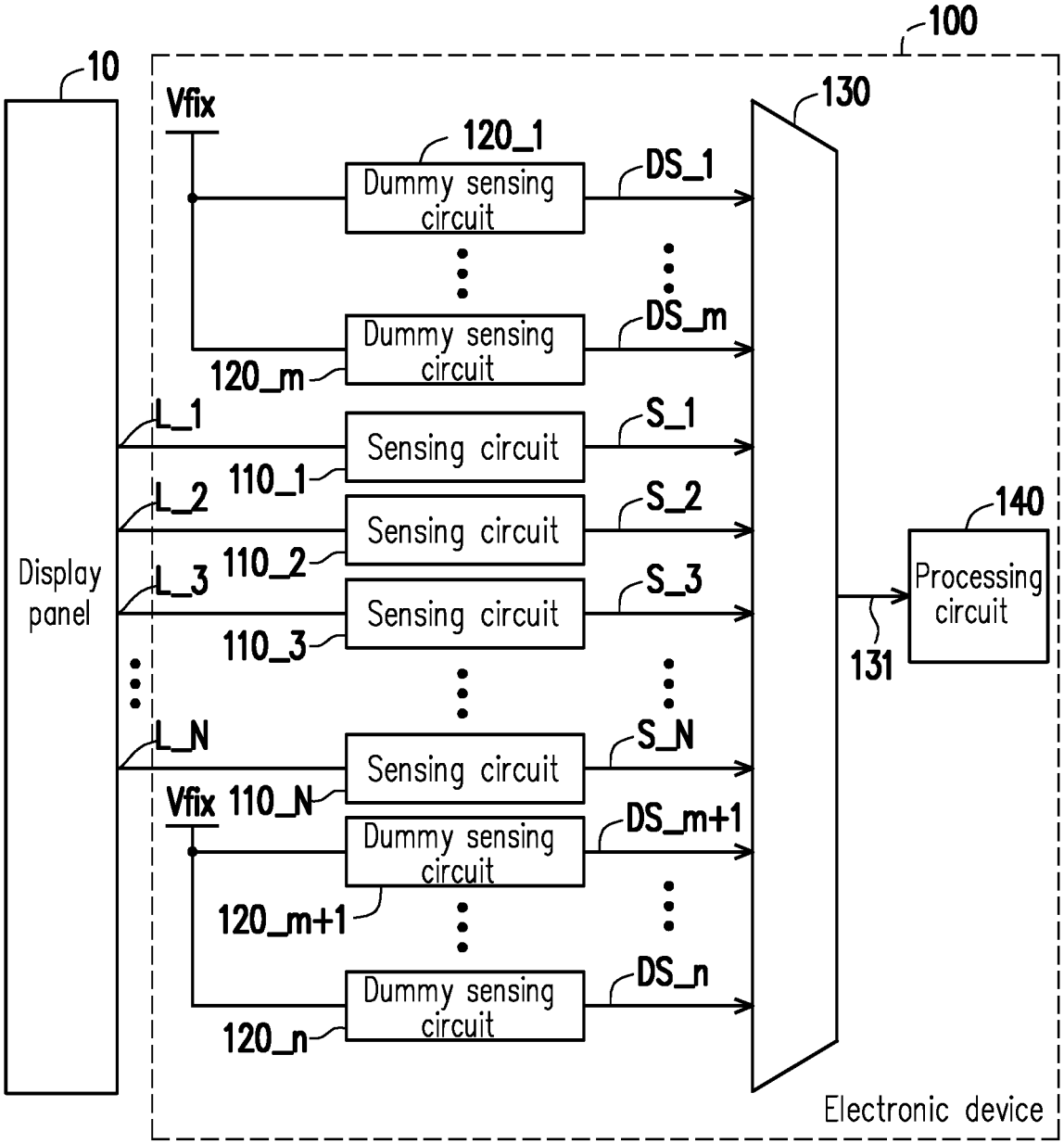
FIG. 1 is a schematic circuit block diagram illustrating an electronic device capable of driving a display panel.

The term "couple (or connect)" herein (including the claims) are used broadly and encompass direct and indirect connection or coupling means. For example, if the disclosure describes a first apparatus being coupled (or connected) to a second apparatus, then it should be interpreted that the first apparatus can be directly connected to the second apparatus, or the first apparatus can be indirectly connected to the second apparatus through other devices or by a certain coupling means. Moreover, elements/components/steps with same reference numerals represent same or similar parts in the drawings and embodiments. Elements/components/notations with the same reference numerals in different embodiments may be referenced to the related description.

FIG. 1 is a schematic circuit block diagram illustrating an electronic device 100 capable of driving a display panel 10. The display panel 10 may be a light emitting diode (LED) display panel such as an organic LED (OLED) display panel or other display panels. In some embodiments, the display panel 10 may be a conventional display panel and thus, will not be repeatedly described. Based on a design requirement, the electronic device 100 may be implemented as a display driving device including a source driver, a timing controller and/or other circuits/elements.

The electronic device 100 includes a plurality of sensing circuits, for example, sensing circuits 110_1, 110_2, 110_3, . . . and 110_N. Therein, N is an integer determined based on a design requirement. Input terminals of the sensing circuits 110_1 to 110_N can be respectively coupled to different sensing lines L_1, L_2, L_3, . . . L_N of the display panel 10 in a one-to-one manner. The sensing circuits 110_1 to 110_N sense the sensing lines L_1 to L_N, so as to respectively output sensing results S_1, S_2, S_3, . . . and S_N.

The electron device 100 further includes a plurality of dummy sensing circuits, for example, dummy sensing circuits 120_1 to 120_m and 120_m+1 to 120_n. Therein, m and n are integers determined based on a design requirement. Based on matching factors and/or based on process factors, the dummy sensing circuits 120_1 to 120_m may be placed at the sensing circuits 110_1 to 110_N, as illustrated in FIG. 1. In order to prevent uncertainty of voltages of the dummy sensing circuits 120_1 to 120_n, input terminals of the dummy sensing circuits 120_1 to 120_n are coupled to a voltage Vfix, so as to output dummy sensing results DS_1 to DS_m and dummy output sensing results DS_m+1 to DS_n. A level of the fixed voltage Vfix may be determined based on a design requirement. For example, the level of the fixed voltage Vfix may be a ground voltage level. Anyway, the fixed voltage Vfix is not related to (independent of) the signals of the sensing lines L_1 to L_N of the display panel 10.

The electronic apparatus 100 further includes a multiplexer circuit 130 and a processing circuit 140. The multiplexer circuit 130 is coupled to the dummy sensing circuits 120_1 to 120_n, so as to receive the dummy sensing results DS_1 to DS_n. The multiplexer circuit 130 is further coupled to the sensing circuits 110_1 to 110_N, so as to receive the sensing results S_1 to S_N. The multiplexer circuit 130 time-divisionally outputs the dummy sensing results DS_1 to DS_n and the sensing results S_1 to S_N from an output terminal of the multiplexer circuit 130. Based on a design requirement, the multiplexer circuit 130 may be a conventional multiplexer or other router circuits. The processing circuit 140 is coupled to the output terminal of the multiplexer circuit 130, so as to time-divisionally receive and process the dummy sensing results DS_1 to DS_n and the sensing results S_1 to S_N. Based on a design requirement, the processing circuit 140 may include an analog-digital converter, thereby converting an output signal 131 output by the multiplexer circuit 130 into digital data. The processing circuit 140 may be a conventional processor or other processing circuits and thus, will not be repeatedly described.

Figure 2:
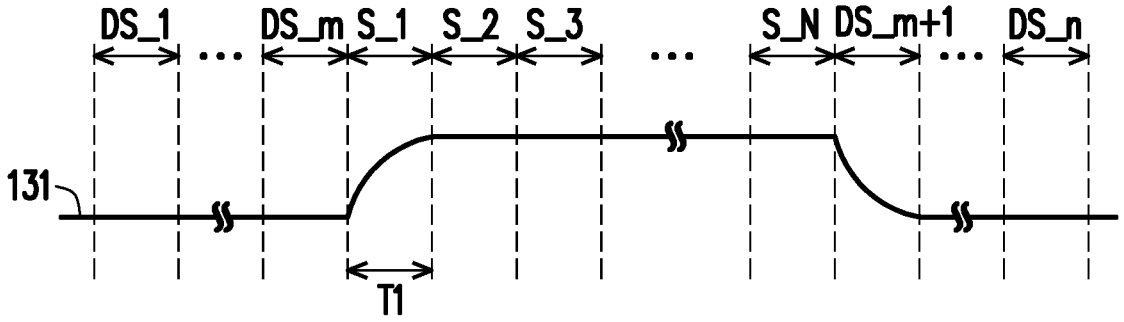
FIG. 2 is a schematic waveform diagram illustrating the output signal of the multiplexer circuit depicted in FIG. 1.

FIG. 2 is a schematic waveform diagram illustrating the output signal 131 of the multiplexer circuit 130 depicted in FIG. 1. In FIG. 2, the horizontal axis represents the time, and the vertical axis represents a voltage (or a current). The multiplexer circuit 130 time-divisionally outputs the dummy sensing results DS_1 to DS_m, the sensing results S_1 to S_N and the dummy sensing results DS_m+1 to DS_n from the output terminal of the multiplexer circuit 130, which becomes the output signal 131 depicted in FIG. 2. Because the fixed voltage Vfix is not related to (independent of) the signals of the sensing lines L_1 to L_N of the display panel 10, a considerable voltage difference exists between the dummy sensing results DS_1 to DS_n and the sensing results S_1 to S_N. Therefore, a state transition occurs to the output signal 131 at a time T1, i.e., a level of the output signal 131 is significantly pulled up from a level of the dummy sensing result DS_m to a level of the sensing result S_1. In an unpreferable state transition, a signal requires a certain time to reach a steady state, as illustrated in FIG. 2. Thus, the output signal 131 received by the processing circuit 140 at the time T1 has an error (which does not have the level of the sensing result S_1).

Figure 3:
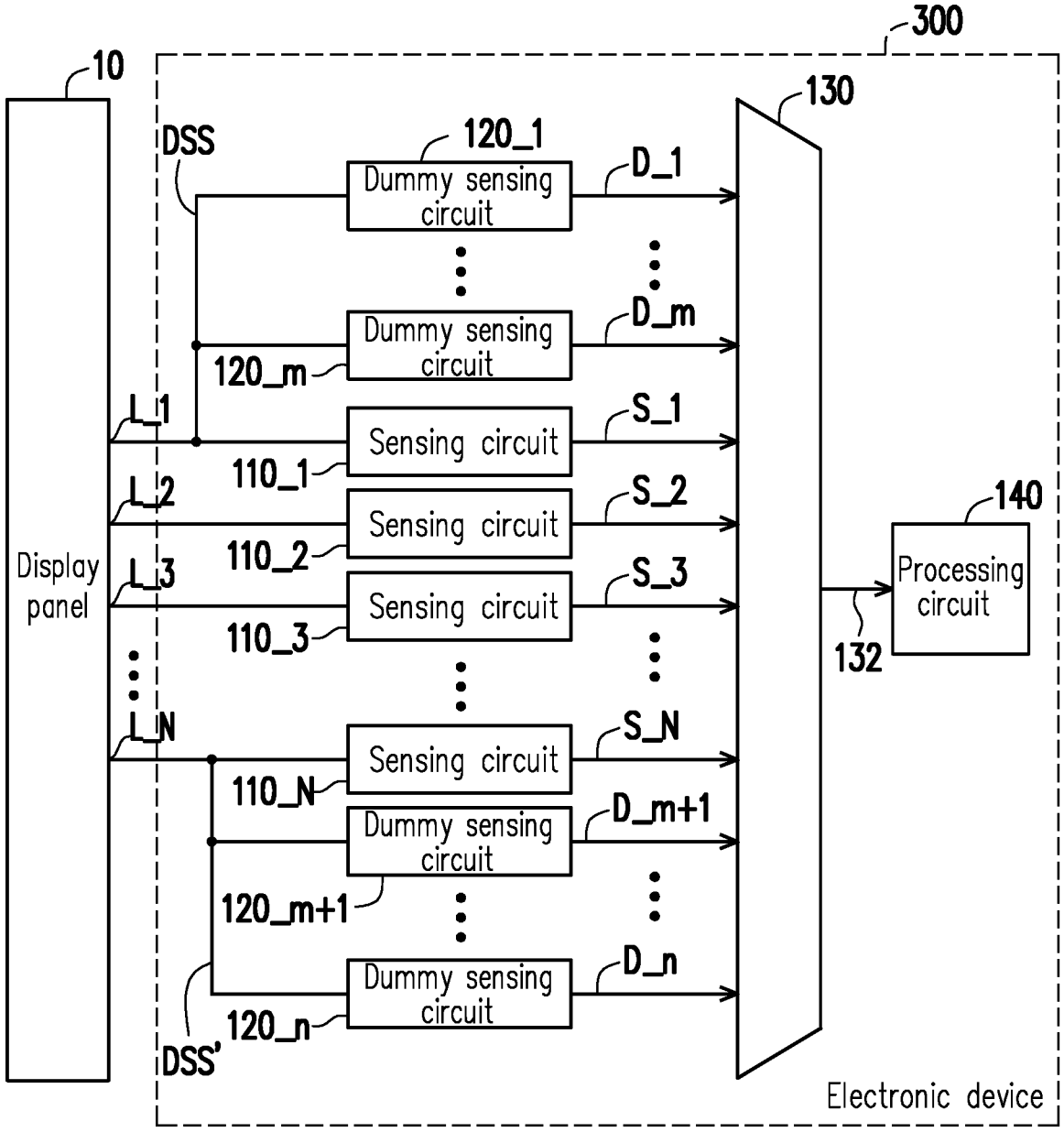
FIG. 3 is a schematic circuit block diagram illustrating an electronic device capable of driving the display panel according to an embodiment of the invention.

FIG. 3 is a schematic circuit block diagram illustrating an electronic device 300 capable of driving the display panel 10 according to an embodiment of the invention. The display panel 10 illustrated in FIG. 3 may refer to the description related to FIG. 1 and thus, will not be repeated. Based on a design requirement, the electronic device 300 may be implemented as a display driving device including a source driver, a timing controller, and/or other circuits/elements. The electronic device 300 includes one or more sensing circuits, for example, the sensing circuits 110_1, 110_2, 110_3, . . . and 110_N as illustrated in FIG. 3. The number N of the sensing circuits 110_1 to 110_N may be determined based on a design requirement. The sensing circuits 110_1 to 110_N may be respectively coupled to different sensing lines L_1 to L_N of the display panel 10 in a one-to-one manner. The sensing circuits 110_1 to 110_N may sense the sensing lines L_1 to L_N, so as to respectively output sensing results S_1, S_2, S_3, . . . and S_N. The sensing circuits 110_1 to 110_N illustrated in FIG. 3 may refer to the description related to FIG. 1 and thus, will not be repeated.

The electronic device 300 further includes one or more dummy sensing circuits, for example, dummy sensing circuits 120_1 to 120_m and 120_m+1 to 120_n. Each of the numbers n, in, (n−m) of the sensing circuits 120_1 to 120_n may be determined based on a design requirement and the number m may be equal to unequal to the number (n−m). The dummy sensing circuits 120_1 to 120_m may be (directly or indirectly) coupled to one or more sensing lines L_p1 to L_p2 respectively or collectively, wherein p1 and p2 are non-zero integers (for example, p1=p2=1). Similarly, the dummy sensing circuits 120_m+1 to 120_n may be (directly or indirectly) coupled to one or more sensing lines L_q1 to L_q2 respectively or collectively, wherein q1 and q2 are non-zero integers (for example, q1=q2=N). This means that different dummy sensing circuits can be coupled to the same or different dummy sensing circuits. In other words, the number m or (n−m) of the dummy sensing circuits on each side may be equal or unequal to the number (p1−p2+1) or (q1−q2+1) of sensing lines among the sensing circuit 120_1-120_N. The dummy sensing circuits 120_1 to 120_n may sense one or more dummy signals, in a specific example as shown, dummy signals DSS and DSS'. The dummy sensing circuits 120_1 to 120_n may output dummy sensing results D_1 to D_m and D_m+1 to D_n related to the dummy signals. The dummy sensing circuits 120_1 to 120_n illustrated in FIG. 3 may refer to the description related to FIG. 1 and thus, will not be repeated. Being different from the embodiment illustrated in FIG. 1, input terminals of the dummy sensing circuits 120_1 to 120_n illustrated in FIG. 3 receive the dummy signals DSS and DSS' (instead of the fixed voltage Vfix).

The dummy signals DSS and DSS' are not fixed voltages. The dummy signals DSS and DSS' are related to a part of or all of signals of the sensing lines L_1 to L_N of the display panel 10. For example, the dummy signal DSS may be a signal of one of the sensing lines L_1 to L_N of the display panel 10, and the dummy signal DSS' may be a signal of another one of the sensing lines L_1 to L_N of the display panel 10. In the embodiment illustrated in FIG. 3, the dummy sensing circuits 120_1 to 120_n are connected to one of the sensing lines L_1 to L_N of the display panel 10, so as to receive a signal of the one of the sensing lines L_1 to L_N from the one of the sensing lines L_1 to L_N, which serves as the dummy signal DSS. The dummy sensing circuits 120_m+1 to 120_n are connected to another one of the sensing lines L_1 to L_N of the display panel 10, so as to receive a signal of aforementioned another one of the sensing lines L_1 to L_N from the sensing line to serve as the dummy signal DSS'.

The electronic apparatus 300 further includes one or more multiplexer circuits (one multiplexer 130 is shown for example) and a processing circuit 140. The multiplexer circuit 130 is coupled to the dummy sensing circuits 120_1 to 120_n, so as to receive dummy sensing results D_1 to D_n. The multiplexer circuit 130 is coupled to the sensing circuits 110_1 to 110_N, so as to receive sensing results S_1 to S_N. The multiplexer circuit 130 time-divisionally outputs the dummy sensing results D_1 to D_n and the sensing results S_1 to S_N from the output terminal of the multiplexer circuit 130, which become an output signal 132. The processing circuit 140 is coupled to the output terminal of the multiplexer circuit 130, so as to time-divisionally receive the dummy sensing results D_1 to D_n and the sensing results S_1 to S_N. The multiplexer circuit 130 and the processing circuit 140 illustrated in FIG. 3 may refer to the description related to FIG. 1 and thus, will not be repeated.

Figure 4:
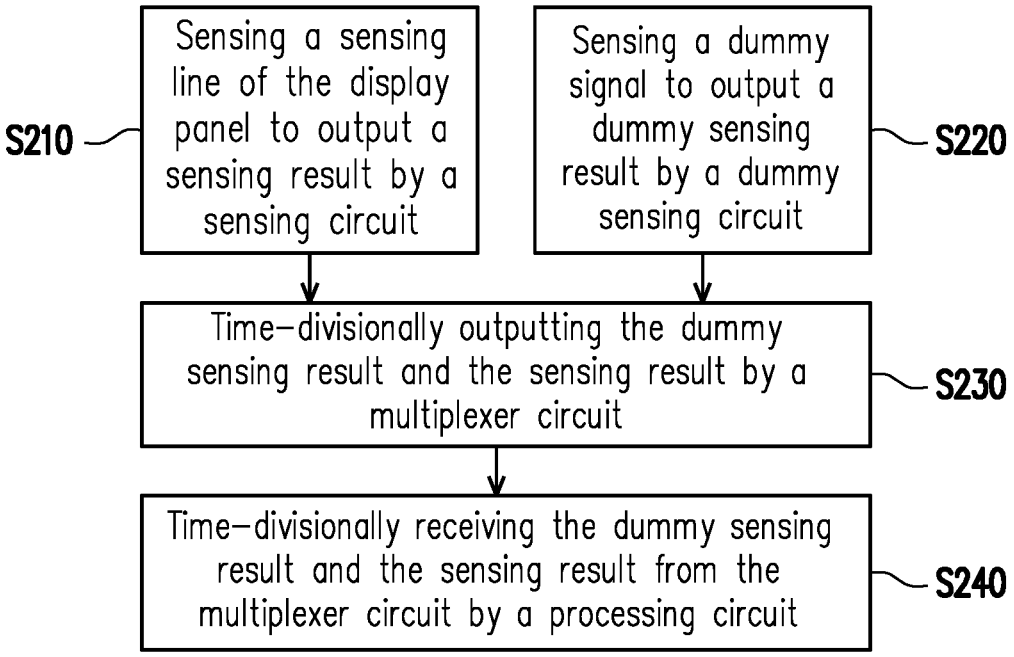
FIG. 4 is a flowchart illustrating an operating method of an electronic device for driving a display panel according to an embodiment of the invention.

FIG. 4 is a flowchart illustrating an operating method of an electronic device for driving a display panel according to an embodiment of the invention. Referring to FIG. 3 and FIG. 4, in step S210, the sensing circuits 110_1 to 110_N may sense different sensing lines L_1 to L_N of the display panel 10, so as to output the sensing results S_1 to S_N. In step S220, the dummy sensing circuits 120_1 to 120_n may sense the dummy signals DSS and DSS', so as to output the dummy sensing results D_1 to D_n. The dummy signals DSS and DSS' are related to a part or all of the signals of the sensing lines L_1 to L_N of the display panel 10. In step S230, the multiplexer circuit 130 time-divisionally outputs the dummy sensing results D_1 to D_n and the sensing results S_1 to S_N from the output terminal of the multiplexer circuit 130. In step S240, the processing circuit 140 time-divisionally receives the dummy sensing results D_1 to D_n and the sensing results S_1 to S_N from the output terminal of the multiplexer circuit 130.

Figure 5:
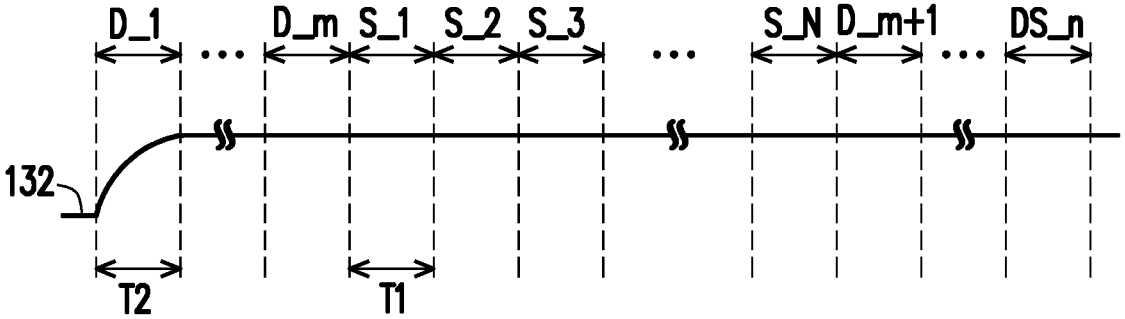
FIG. 5 is a schematic waveform diagram illustrating the output signal of the multiplexer circuit depicted in FIG. 3 according to an embodiment of the invention.

FIG. 5 is a schematic waveform diagram illustrating the output signal 132 of the multiplexer circuit 130 depicted in FIG. 3 according to an embodiment of the invention. In FIG. 5, the horizontal axis represents the time, and the vertical axis represents a voltage (or a current). The multiplexer circuit 130 time-divisionally outputs the dummy sensing results D_1 to D_m, the sensing results S_1 to S_N and the dummy sensing results D_m+1 to D_n from the output terminal of the multiplexer circuit 130, which become the output signal 132 illustrated in FIG. 5. Because the dummy signals DSS and DSS' are related to the signals of the sensing lines of the display panel 10, a voltage difference (or a current difference) between the dummy sensing results D_1 to D_n and the sensing results S_1 to S_N may be effectively diminished. Namely, a change of a level of the output signal 132 at the time T1 (which is switched from a level of the dummy sensing result D_m to a level of the sensing result S_1) can be sufficiently small to be ignored (or to be tolerated). Compared to FIG. 2, a time point at which a state transition occurs to the output signal 132 is advanced from the time T1 to a time T2 in FIG. 5. FIG. 5 illustrates that the state transition occurs to the output signal 132 at the time T2, the dummy sensing result D_1 is generally ignored. Thus, an error of the output signal 132 existing at the time T2 cannot influence a sensing operation performed on the display panel 10 by the electronic device 300.

Figure 6:
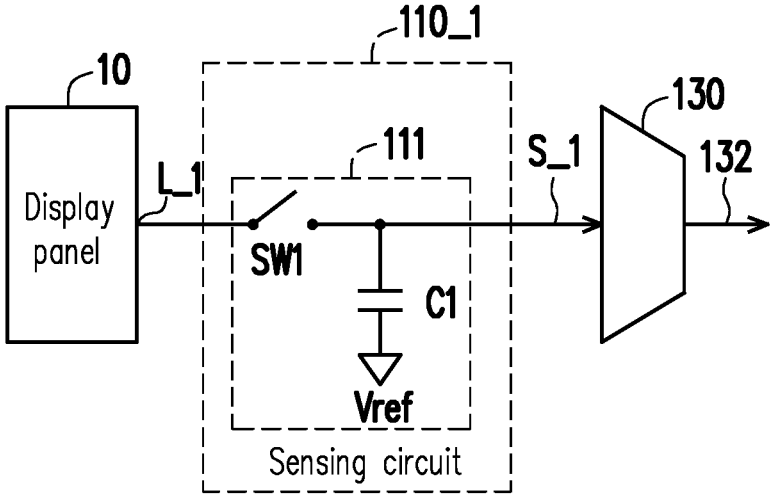
FIG. 6 is a schematic circuit block diagram illustrating the sensing circuit depicted in FIG. 3 according to an embodiment of the invention.

FIG. 6 is a schematic circuit block diagram illustrating the sensing circuit 110_1 depicted in FIG. 3 according to an embodiment of the invention. The rest of the sensing circuits 110_2 to 110_N illustrated in FIG. 3 may be inferred with reference to the description related to the sensing circuit 110_1 and thus, will not be repeated. In the embodiment illustrated in FIG. 6, the sensing circuit 110_1 includes a sampling and holding circuit 111. The sampling and holding circuit 111 may include a switching circuit SW1 and a capacitor C1. The switching circuit SW1 has a first terminal configured to be coupled to one of the sensing lines L_1 to L_N of the display panel 10 and a second terminal coupled to the multiplexer circuit 130 to provide the sensing result S_1. A first terminal o the capacitor C1 is coupled to the second terminal of the switching circuit SW1 and a second terminal coupled to a reference voltage Vref. A level of the reference voltage Vref may be determined based on a design requirement. In a sampling period, the switching circuit SW1 is turned on, and thus, the capacitor C1 may sample a signal of one of the sensing lines L_1 to L_N of the display panel 10 through the switching circuit SW1. In a holding period, the switching circuit SW1 is turned off, and thus, the sampled signal of the sensing line may be held in the capacitor C1. The sampled signal of the sensing line held in the capacitor C1 may serve as the sensing result S_1. It is noted that other available structures of sampling and holding circuit or circuits capable of sensing/transmitting signals from display panel to the processing circuit can be utilized in the sensing circuit according to design requirements.

Figure 7:
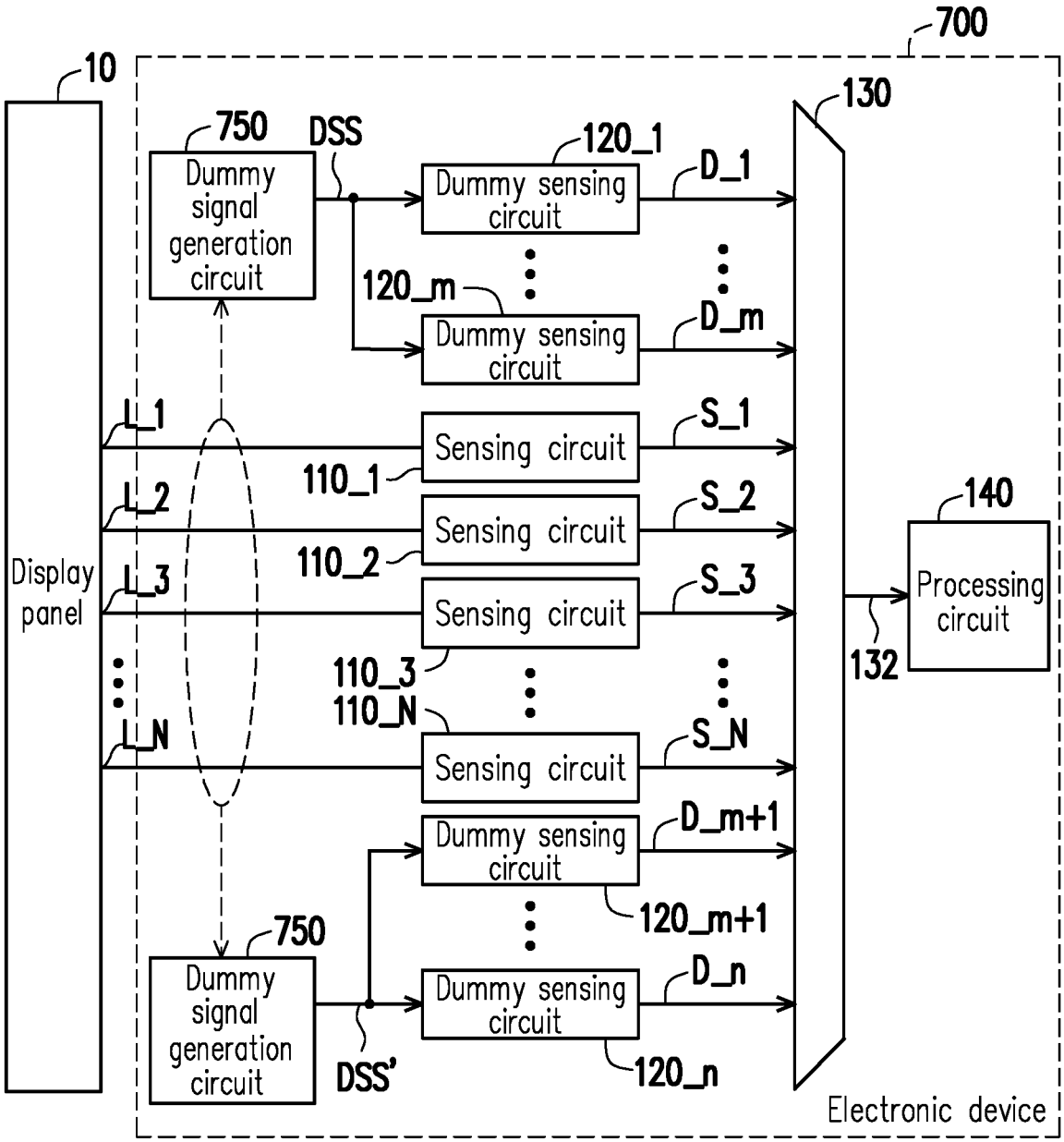
FIG. 7 is a schematic circuit block diagram illustrating an electronic device capable of driving a display panel according to another embodiment of the invention.

FIG. 7 is a schematic circuit block diagram illustrating an electronic device 700 capable of driving the display panel 10 according to an embodiment of the invention. Based on a design requirement, the electronic device 700 may be implemented as a display driving device including a source driver, a timing controller, and/or other circuits/elements. The electronic device 700 includes sensing circuits 110_1 to 110_N, dummy sensing circuits 120_1 to 120_n, a multiplexer circuit 130, a processing circuit 140 and a dummy signal generation circuit 750. The display panel 10 illustrated in FIG. 7 may refer to the descriptions related to FIG. 1 and FIG. 3 and thus, will not be repeated. The sensing circuits 110_1 to 110_N, the dummy sensing circuits 120_1 to 120_n, the multiplexer circuit 130 and the processing circuit 140 may refer to the descriptions related to FIG. 3 through FIG. 6 and thus, will not be repeated.

The dummy signal generation circuit 750 is coupled between a part or all of the sensing lines L_1 to L_N of the display panel 10 and the dummy sensing circuits 120_1 to 120_n, as illustrated in FIG. 7. The dummy signal generation circuit 750 may generate a part or both of the dummy signals DSS and DSS' related to the part or the all of signals and provide the dummy signals DSS and DSS' to the dummy sensing circuits 120_1 to 120_n. In some embodiments, the dummy signals DSS and DSS' are related to a voltage (or a current) of one of the sensing lines L_1 to L_N of the display panel 10. In some other embodiments, the dummy signals DSS and DSS' are related to a plurality of voltages (or currents) of a plurality of sensing lines among the sensing lines L_1 to L_N of the display panel 10.

Figure 8:
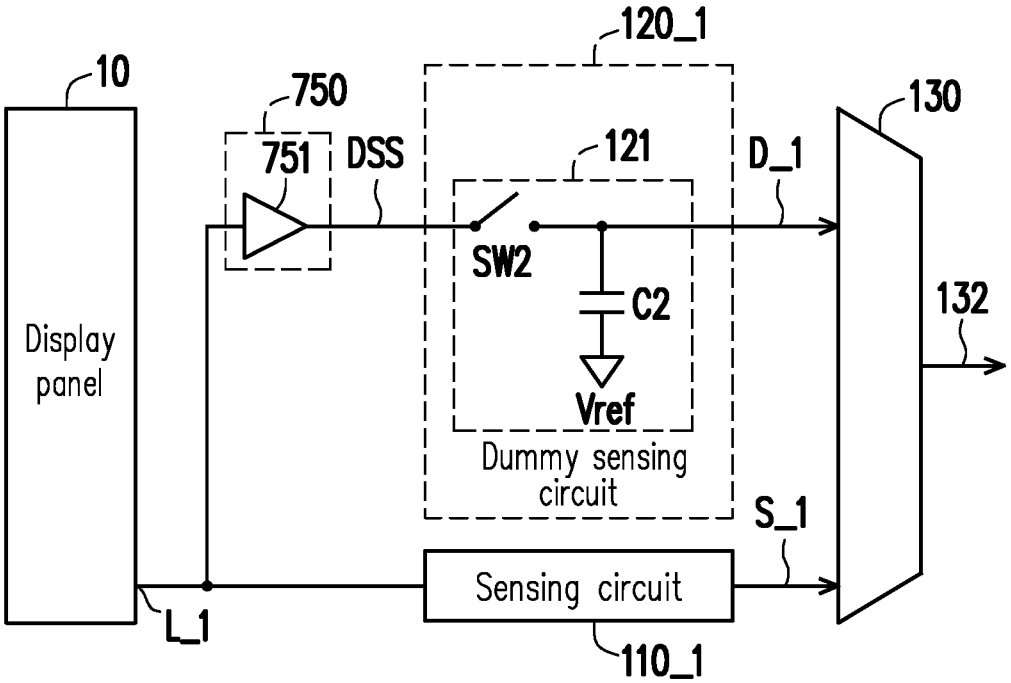
FIG. 8 is a schematic circuit block diagram illustrating the dummy sensing circuit and the dummy signal generation circuit depicted in FIG. 7 according to an embodiment of the invention.

FIG. 8 is a schematic circuit block diagram illustrating the dummy sensing circuit 120_1 and the dummy signal generation circuit 750 depicted in FIG. 7 according to an embodiment of the invention. The rest of the dummy sensing circuits illustrated in FIG. 7 may be inferred with reference to the description related to the sensing circuit 120_1 and thus, will not be repeated. In the embodiment illustrated in FIG. 8, the dummy sensing circuit 120_1 includes a sampling and holding circuit 121. The sampling and holding circuit 121 includes a switching circuit SW2 and a capacitor C2. The switching circuit SW2 has a first terminal configured to be coupled to the dummy signal generation circuit 750 to receive the dummy signal DSS. A second terminal of the switching circuit SW2 is coupled to the multiplexer circuit 130 to provide the dummy sensing result D_1. A first terminal o the capacitor C2 is coupled to the second terminal of the switching circuit SW2, and a second terminal of the capacitor C2 is coupled to a reference voltage Vref. A level of the reference voltage Vref may be determined based on a design requirement. In a sampling period, the switching circuit SW2 is turned on, and thus, the capacitor C2 may sample the dummy signal DSS generated by the dummy signal generation circuit 750 through the switching circuit SW2. In a holding period, the switching circuit SW2 is turned off, and thus, the dummy signal DSS may be held in the capacitor C2. The dummy signal DSS held in the capacitor C2 may serve as the dummy sensing result D_1.

In the embodiment illustrated in FIG. 8, the dummy signal generation circuit 750 includes a buffer circuit 751. An input terminal of the buffer circuit 751 is coupled to at least one of the sensing lines L_1 to L_N of the display panel 10. An output terminal of the buffer circuit 751 is coupled to the dummy sensing circuit 120_1 to provide the dummy signals DSS related to the sensing line of the display panel 10. In the embodiment illustrated in FIG. 8, the dummy signal DSS is related to a voltage (or a current) of one of the sensing lines L_1 to L_N of the display panel 10. The aforementioned sensing line (which is the sensing line connected to the buffer circuit 751) is the sensing line which is the most adjacent to the dummy sensing circuit 120_1.

Figure 9:
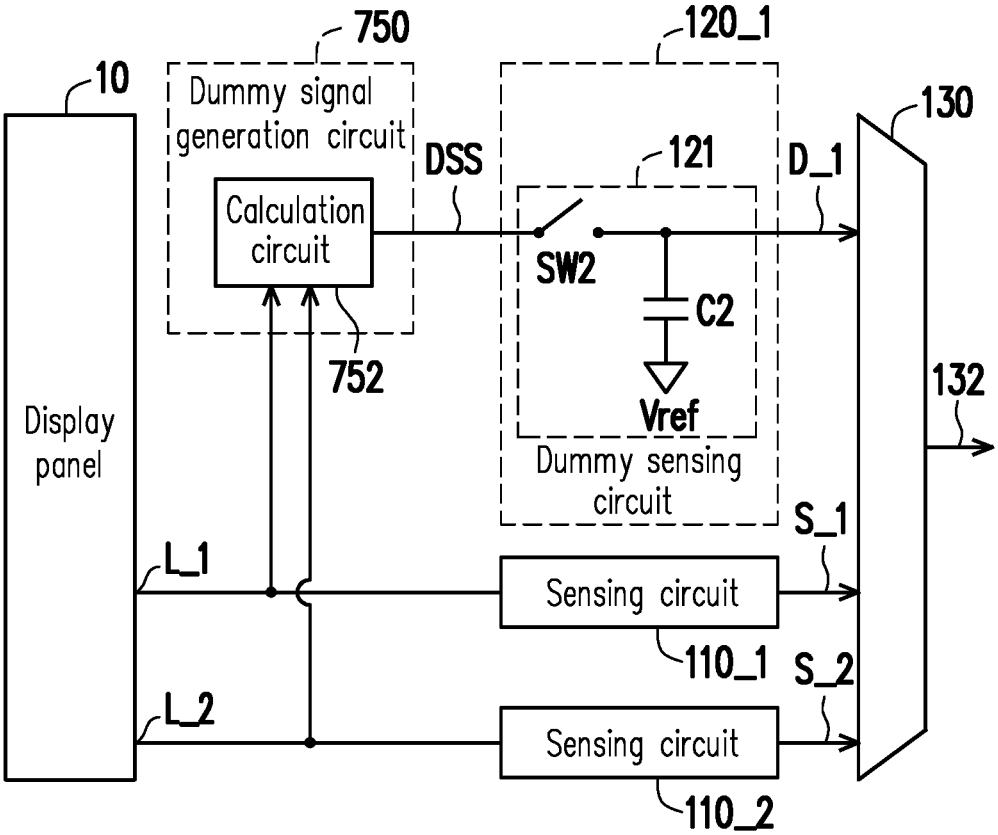
FIG. 9 is a schematic circuit block diagram illustrating the dummy signal generation circuit depicted in FIG. 7 according to another embodiment of the invention.

FIG. 9 is a schematic circuit block diagram illustrating the dummy signal generation circuit 750 depicted in FIG. 7 according to another embodiment of the invention. The rest of the dummy sensing circuits illustrated in FIG. 7 may be inferred with reference to the description related to the dummy sensing circuit 120_1 and thus, will not be repeated. The sensing circuit 120_1 illustrated in FIG. 9 may refer to the description related to FIG. 8 and thus, will not be repeated. The dummy signal generation circuit 750 illustrated in FIG. 9 includes a calculation circuit 752. The calculation circuit 752 has at least one input terminal (directly or indirectly) coupled to at least one of the sensing lines L_1 to L_N (referred to as the coupled sensing line) of the display panel 10. In the embodiment illustrated in FIG. 9, an input terminal of the calculation circuit 752 and an input terminal of the sensing circuit 110_1 are jointly coupled to one of the sensing lines L_1 to L_N of the display panel 10, and another input terminal of the calculation circuit 752 and an input terminal of the sensing circuit 110_2 are jointly coupled to another one of the sensing lines L_1 to L_N of the display panel 10. At least one output terminal of the buffer circuit 752 is coupled to the dummy sensing circuit 120_1. The calculation circuit 7520 is configured to calculate the dummy signal DSS according to one or more voltages/currents (shown as one voltage/current for example) of the one or more coupled sensing lines (shown as one coupled sensing line for example).

In the embodiment illustrated in FIG. 9, the dummy signal DSS is related to voltages (or currents) of a plurality of sensing lines among the sensing lines L_1 to L_N of the display panel 10. The coupled sensing lines of the display panel 10 (which are connected to the calculation circuit 752) can be the sensing lines which are the most adjacent to the dummy sensing circuit 120_1. The dummy signal DSS may be related to an average or a weighted value of the voltages (or the currents) of the plurality of coupled sensing lines. Namely, the calculation circuit 752 may sense the voltages (or the currents) of the coupled sensing lines and calculate the average or the weighted value of the voltages (or the currents) of the coupled sensing lines to serve as the dummy signal DSS.

In light of the foregoing, the sensing circuits of the embodiments of the invention can sense the sensing lines of the display panel, and the dummy sensing circuit can sense the dummy signals. The dummy signals are related to the part of or the all of the signals of the sensing lines of the display panel. Because the dummy signals are related to the signals of the sensing lines, the difference between the sensing results of the sensing circuits and the dummy sensing results of the dummy sensing circuits can be effectively diminished or reduced.

Although the invention has been disclosed by the above embodiments, they are not intended to limit the invention. It will be apparent to one of ordinary skill in the art that modifications and variations to the invention may be made without departing from the spirit and scope of the invention. Therefore, the scope of the invention will be defined by the appended claims.

What is claimed is:

1. An electronic device capable of driving a display panel comprising a plurality of sensing lines, comprising:

a plurality of sensing circuits, each of the plurality of sensing circuits configured to be coupled to a corresponding one sensing line of the display panel, and each of the plurality of sensing circuits configured to sense the corresponding sensing line to output a sensing result;

at least one dummy sensing circuit, configured to sense at least one dummy signal to output at least one dummy sensing result, wherein the at least one dummy signal is related to a part of or all of signals of the sensing lines; and a multiplexer circuit, coupled to the at least one dummy sensing circuit to receive the at least one dummy sensing result and coupled to the plurality of sensing circuits to receive the sensing results, wherein the multiplexer circuit is configured to output the at least one dummy sensing result during a first period and output the sensing results during a second period after the first period.

2. The electronic device according to claim 1, wherein the at least one dummy sensing circuit is connected to the at least one sensing line to receive the part of or the all of signals of the at least one sensing line from the at least one sensing line and serve the part of or the all of signals as the at least one dummy signal.

3. The electronic device according to claim 1, wherein each of the plurality of sensing circuits comprises a sampling and holding circuit.

4. The electronic device according to claim 3, wherein the sampling and holding circuit comprises:

a switching circuit, having a first terminal configured to be coupled to the sensing line of the display panel and a second terminal coupled to the multiplexer circuit to provide the sensing result; and a capacitor, having a first terminal coupled to the second terminal of the switching circuit and a second terminal coupled to a reference voltage.

5. The electronic device according to claim 1, further comprising: a dummy signal generation circuit, configured to be coupled between a part of or all of the at least one sensing line and the at least one dummy sensing circuit, wherein the dummy signal generation circuit is configured to generate the at least one dummy signal related to the part of or the all of signals of the at least one sensing line and provide the at least one dummy signal to the at least one dummy sensing circuit.

6. The electronic device according to claim 5, wherein each of the at least one dummy sensing circuit comprises a sampling and holding circuit.

7. The electronic device according to claim 6, wherein the sampling and holding circuit comprises:

a switching circuit, having a first terminal configured to be coupled to the dummy signal generation circuit to receive the dummy signal and a second terminal coupled to the multiplexer circuit to provide the at least one dummy sensing result; and a capacitor, having a first terminal configured to be coupled to the second terminal of the switching circuit and a second terminal coupled to a reference voltage.

8. The electronic device according to claim 6, wherein the dummy signal generation circuit comprises:

a buffer circuit, having an input terminal coupled to one of the at least one sensing line of the display panel and an output terminal coupled to the at least one dummy sensing circuit to provide the dummy signal related to the one of the sensing line.

9. The electronic device according to claim 6, wherein the dummy signal generation circuit comprises:

an calculation circuit, having at least one input terminal coupled to at least one coupled sensing line among the at least one sensing line of the display panel and at least one output terminal coupled to the at least one dummy sensing circuit, and configured to calculate the dummy signal according to a voltage or a current of the at least one coupled sensing line.

10. The electronic device according to claim 1, wherein the at least one dummy signal is related to a voltage or a current of one of the at least one sensing line.

11. The electronic device according to claim 10, wherein the one of the plurality of sensing circuits is the sensing line which is the most adjacent to one of the at least one dummy sensing circuit.

12. The electronic device according to claim 1, wherein the dummy signal is related to voltages or currents of a plurality of sensing lines among the at least one sensing line.

13. The electronic device according to claim 12, wherein the plurality of sensing lines among the at least one sensing line are the sensing lines which are the most adjacent to one of the at least one dummy sensing circuit.

14. The electronic device according to claim 13, wherein the dummy signal is related to an average or a weighted value of the voltages or the currents of the plurality of sensing lines.

15. The electronic device according to claim 1, further comprising:

a processing circuit, coupled to the output terminal of the multiplexer circuit to time-divisionally receive the at least one dummy sensing result and the at least one sensing result.

16. The electronic device according to claim 1, wherein a total number of the sensing circuits is equal to a total number of the sensing lines.

17. The electronic device according to claim 16, wherein each of the sensing circuits is directly connected to the corresponding sensing line, and each of at least one dummy sensing line is indirectly coupled to one of the sensing lines.

18. The electronic device according to claim 1, wherein a total number of the at least one dummy sensing circuit is less than a total number of the sensing circuits.

19. The electronic device according to claim 1, wherein the sensing circuits and the at least one dummy sensing circuit have the same circuit structure.

20. An operation method of an electronic device for driving a display panel, comprising:

sensing at least one sensing line of the display panel to output at least one sensing result by a plurality of sensing circuits;

sensing at least one dummy signal to output at least one dummy sensing result by at least one dummy sensing circuit, wherein the at least one dummy signal is related to a part of or all of signals of the at least one sensing line; and outputting the at least one dummy sensing result during a first period and outputting the sensing results during a second period after the first period by a multiplexer circuit.

21. The operation method according to claim 20, wherein the at least one dummy sensing circuit is connected to the at least one sensing line to receive the part of or the all of signals of the at least one sensing line from the at least one sensing line and serve the part of or the all of signals as the at least one dummy signal.

22. The operation method according to claim 20, wherein each of the plurality of sensing circuits comprises a sampling and holding circuit.

23. The operation method according to claim 20, wherein the electronic device further comprise a dummy signal generation circuit configured to be coupled between a part of or all of the at least one sensing line and the at least one dummy sensing circuit, and the operation method further comprises:

generating, by the dummy signal generation circuit, the at least one dummy signal related to a part of or all of signals of the at least one sensing line and providing the at least one dummy signal to the at least one dummy sensing circuit.

24. The operation method according to claim 23, wherein each of the at least one dummy sensing circuit comprises a sampling and holding circuit.

25. The operation method according to claim 20, wherein the dummy signal is related to a voltage or a current of one of the at least one sensing line.

26. The operation method according to claim 25, wherein the one of the plurality of sensing circuits is the sensing line which is the most adjacent to one of the at least one dummy sensing circuit.

27. The operation method according to claim 20, wherein the dummy signal is related to voltages or currents of a plurality of sensing lines among the at least one sensing line.

28. The operation method according to claim 27, wherein the plurality of sensing lines among the at least one sensing line are the sensing lines which are the most adjacent to one of the at least one dummy sensing circuit.

29. The operation method according to claim 28, wherein the dummy signal is related to an average or a weighted value of the voltages or the currents of the plurality of sensing lines.

30. The operation method according to claim 20, further comprising:

time-divisionally receiving the at least one dummy sensing result and the at least one sensing result from the output terminal of the multiplexer circuit by a processing circuit.

31. An electronic device capable of driving a display panel comprising a plurality of sensing lines, comprising:

a plurality of sensing circuits, each of the plurality of sensing circuits configured to be coupled to a corresponding sensing line of the display panel, and each of the plurality of sensing circuits configured to sense the corresponding sensing line to output a sensing result;

at least one dummy sensing circuit, configured to sense at least one dummy signal to output at least one dummy sensing result, wherein the at least one dummy signal is related to a part of or all of signals of the sensing lines; and a multiplexer circuit, coupled to the at least one dummy sensing circuit to receive the at least one dummy sensing result and coupled to the plurality of sensing circuits to receive the sensing results, wherein the multiplexer circuit is configured to time-divisionally output the at least one dummy sensing result and the at least one sensing result from an output terminal of the multiplexer circuit;

wherein each of the sensing circuits is directly connected to the corresponding sensing line, and each of at least one dummy sensing line is indirectly coupled to one of the sensing lines.

32. The electronic device according to claim 31, further comprising:

a processing circuit, coupled to the output terminal of the multiplexer circuit to time-divisionally receive the at least one dummy sensing result and the at least one sensing result.

33. The electronic device according to claim 31, wherein the sensing circuits and the at least one dummy sensing circuit have the same circuit structure.

34. The electronic device according to claim 31, wherein the multiplexer circuit is configured to output the at least one dummy sensing result during a first period and output the sensing results during a second period after the first period.

35. An electronic device capable of driving a display panel comprising a plurality of sensing lines, comprising:

a plurality of sensing circuits, each configured to be coupled to a corresponding one sensing line of the display panel, and each configured to sense the corresponding sensing line to output a sensing result, wherein a total number of the sensing circuits is equal to a total number of the sensing lines;

at least one dummy sensing circuit, configured to sense at least one dummy signal to output at least one dummy sensing result, wherein the at least one dummy signal is dynamically varied, and a total number of the at least one dummy sensing circuit is less than the total number of the sensing circuits; and a multiplexer circuit, coupled to the at least one dummy sensing circuit to receive the at least one dummy sensing result and coupled to the at least one sensing circuit to receive the at least one sensing result, wherein the multiplexer circuit is configured to wherein the multiplexer circuit is configured to time-divisionally output the at least one dummy sensing result and the at least one sensing result from an output terminal of the multiplexer.

36. The electronic device according to claim 35, wherein each of the sensing circuits is directly connected to the corresponding sensing line, and each of the at least one dummy sensing line is indirectly coupled to one of the sensing lines.

37. The electronic device according to claim 36, wherein the at least one dummy signal is dynamically varied according to at least one of the sensing results.

38. The electronic device according to claim 35, wherein the multiplexer circuit is configured to output the at least one dummy sensing result during a first period and output the sensing results during a second period after the first period.

* * * * *